United States Patent [19]

Blumenthal et al.

[11] 4,280,734

[45] Jul. 28, 1981

[54] ARRANGEMENT FOR CONTROLLED ENGAGEMENT OF THE TOOLS OF A MINING MACHINE WITH A MINE FACE

[75] Inventors: Günter Blumenthal, Westerholt; Alfred Bollmann, Bochum, both of Fed. Rep. of Germany

[73] Assignee: Bochumer Eisenhuette Heintzmann GmbH & Co., Bochum, Fed. Rep. of Germany

[21] Appl. No.: 99,738

[22] Filed: Dec. 3, 1979

[30] Foreign Application Priority Data

Dec. 2, 1978 [DE] Fed. Rep. of Germany ..... 2852305

[51] Int. Cl.[3] ..... E21C 27/32

[52] U.S. Cl. ..... 299/34; 299/43

[58] Field of Search ..... 299/32, 34, 43

[56] References Cited

U.S. PATENT DOCUMENTS

| | | | |
|---|---|---|---|
| 3,276,819 | 10/1966 | Lobbe et al. | 299/32 |
| 3,765,723 | 10/1973 | Lobbe et al. | 299/32 X |
| 3,841,706 | 10/1974 | Huttenbrauck et al. | 299/34 |
| 3,874,734 | 4/1975 | Plevak et al. | 299/32 |
| 3,915,500 | 10/1975 | Schlusener et al. | 299/32 |
| 4,200,338 | 4/1980 | Beckmann | 299/34 |

*Primary Examiner*—Ernest R. Purser

*Attorney, Agent, or Firm*—Michael J. Striker

[57] ABSTRACT

An arrangement for controlled engagement of the tools of a coal planer, with a mine face comprises a scraper conveyor, provided on its front face directed toward the mine face with a guide rail guiding the coal planer for reciprocation along the mine face and a mechanism for tilting the conveyor and the coal planer about a substantially horizontal axis. The tilting mechanism is connected to the rear face of the conveyor and extends in its entirety rearwardly of the rear face of the latter. The tilting mechanism comprises a guide linkage pivotally connected at its front end to the rear face of the scraper conveyor while its rear end portion forms a housing for a fluid operated cylinder and piston unit, the piston rod of which is connected to a connecting rod guided by the guide linkage for movement in longitudinal direction and having an upwardly extending front section pivotally connected at its upper free end to the rear face of the scraper conveyor. The fluid operated cylinder-and-piston unit is thus considerably spaced from the scraper conveyor and the material transported thereby and especially coal dust raised during transport of the mined coal by the conveyor, whereby maintenance of the tilting unit is reduced. The guide linkage, the connecting rod and the tilting unit are all in close vicinity to the sole of the mine gallery to leave a considerable free space between the arrangement and the roof of the mine gallery.

12 Claims, 4 Drawing Figures

ARRANGEMENT FOR CONTROLLED ENGAGEMENT OF THE TOOLS OF A MINING MACHINE WITH A MINE FACE

BACKGROUND OF THE INVENTION

The present invention relates to an arrangement for controlled engagement of the tools of a mining machine, especially a coal planer, with a mine face, in which the mining machine is mounted on the front face of an abutment, for instance a scraper conveyor, for reciprocation along the mine face and which includes means for tilting the abutment and the mining machine mounted thereon about a substantially horizontal axis.

Such an arrangement is known in the art and disclosed in the German Auslegeschrift No. 23 19 910. This known arrangement includes a guide linkage comprising two parallel transversely spaced rods located above the sole of the mine gallery. The tilting unit for the abutment constituted by a scraper conveyor with a coal planer mounted for reciprocation on its front face, extends rearwardly of the scraper conveyor and includes a substantially vertically arranged fluid operated cylinder and piston unit, the cylinder of which is connected over fixed connecting elements to the rear face of the scraper conveyor, whereas the piston rod of the unit is connected to the guide rods rearwardly of a horizontal tilting axis by means of which the front ends of the guide rods are connected to the scraper conveyor. By impinging the piston of the cylinder and piston unit on one or the other face thereof with pressure fluid it is therefore possible to tilt the scraper conveyor and the coal planer guided thereon in such a manner that the tools of the coal planer are pressed into the sole of the mine gallery or move out of the same.

A disadvantage of this known arrangement is especially the position of the tilting unit. As mentioned before this tilting unit extends in vertical direction and is located in close vicinity of the scraper conveyor to reduce thereby the free space between the scraper conveyor and the mine roof support, which, especially during mining of coal seams of small heights, is considerably small. This condition is further aggravated by the considerable distance of the guide linkage above the mine floor of the mine gallery. Even if a more or less satisfactory free space should be available, then it is only obtainable with a mine roof support in which the free forwardly extending roof shield is of considerable length. This in turn will lead to an unsatisfactory introduction of the force for supporting the mine roof.

Another disadvantage of this known arrangement is that the tilting unit is directly subjected to the influence of the material transported by the scraper conveyor. Thereby, not only the cylinder and piston unit of the tilting arrangement, but also the conduits for feeding pressure fluid thereto, are subjected to increased wear resulting from the dust of the material transported by the scraper conveyor. Likewise, the necessary valves for the operation of the cylinder and piston unit are subjected to the detrimental influence of the material transported by the scraper conveyor which will evidently result in the increased necessary maintenance.

SUMMARY OF THE INVENTION

It is therefore an object of the present invention to provide an arrangement for the controlled engagement of the tools of a mining machine, especially a coal planer, with a mine face in an underground mining gallery in which the arrangement is constructed in such a manner that it will provide, even during mining of coal seams of small height, still a sufficient free space above the arrangement and which, as compared with the above-described known arrangement is subjected to less wear and tear.

With these and other objects in view, which will become apparent as the description proceeds, the arrangement according to the present invention for controlled engagement of the tools of the mining machine, especially a coal planer, with a mine face in an underground mining gallery mainly comprises abutment means having a front face directed toward the mine face and a rear face, guide rail means on the front face of the abutment means for guiding a mining machine for reciprocation along the mine face and means for tilting the abutment means and the mining machine guided thereon about a substantially horizontal axis. The tilting means according to the present invention comprise elongated guide linkage means adapted to be rest on the floor of the mine gallery and having a front end pivotally connected to the rear face of the abutment means, a connecting rod guided in the guide linkage means for movement in longitudinal direction and having an upwardly extending front end section pivotally attached in the region of the upper end thereof to the rear face of the abutment means, and a tilting unit extending in the direction of the guide means, embedded in a section of the latter located rearwardly of the front end of said guide means, and pivotally attached to the rear end of the connecting rod.

Due to this arrangement, the tilting unit, thus considerably spaced from the abutment, which, for instance, is a scrapper conveyor, is not subjected any longer to the detrimental influence of the material transported by the conveyor. An additional advantage is obtained in that the guide linkage and the connecting rod guided in longitudinal direction thereon may be directly placed on the sole of the mine gallery so that in this way, even during mining of coal seams of small height, still a sufficient space will be located above the guide means and the connecting rod.

The above-mentioned tilting unit is constructed as a fluid operated cylinder and piston unit which, by corresponding impinging of the piston thereof with pressure fluid, moves the connecting rod in longitudinal direction relative to the guide linkage means so that the upwardly extending front end section of the connecting rod, which is pivotally attached in the region of the upper end to the rear face of the abutment means, will cause tilting of the latter about the pivot axis connecting the front end of the guide linkage means to the rear face of the abutment. The abutment will tilt thereby about the aforementioned tilting axis so that the tools of the mining machine guided on the front face of the abutment will be pushed toward the sole of the mine gallery or away from the latter.

The arrangement according to the present invention has therefore the decisive advantage that the tilting arrangement will provide rearwardly of the abutment a considerable free space above the tilting arrangement and that in the region of the abutment the tilting arrangement includes only simple mechanical parts for the tilting of the abutment and such parts may be constructed in a very sturdy manner requiring practically no maintenance.

A further improvement of the arrangement according to the present invention, which facilitates the use thereof during mining of coal seams of small height, results from a construction in which the guide linkage and the connecting rod guided therein have in the region between the hinge connection of the guide means to the rear face of the abutment means and the hinge connection between the rear end of the connecting rod and the tilting unit trough-shaped portions having each wall portions adapted to engage the sole of the mine gallery of substantially the same thickness. The connecting rod can thereby be guided in longitudinal direction between two parallel extending flat bars of the guide linkage.

According to a further advantageous construction, the guide means has in the region of its pivotally attached front end a raised transverse web and the connecting rod passes beneath the transverse web and is provided at its upwardly extending front end portion with a rearwardly projecting nose which overlaps this transverse web. This relatively little space requiring transverse web of the guide linkage is thus encompassed on one side by the aforementioned nose on the upwardly extending section of the connecting rod and the horizontal section of the latter and limits thereby relative movement of the guide linkage and the connecting rod during movement of the latter in longitudinal direction.

In this connection it is also of advantage that the transverse web extends between two vertical ribs projecting upwardly and forwardly from the bar-shaped sections of the guide linkage toward the mine face. These ribs, which are smaller than the bar-shaped sections, engage between fork-shaped elements which project rearwardly from the rear face of the abutments and are pivotally connected thereto by a transverse bolt.

According to a further feature of the present invention, the upwardly extending front end section of the connecting rod has in the region of its upper free end a lug provided with an oblong aperture through which a pivot pin carried by the abutment means in the upper region of the rear face thereof extends. Of course, it is possible to reverse this arrangement in such a manner that the lug provided with the oblong aperture is fixed to the rear face of the abutment means, whereas the pivot pin which is to extend through the aperture is carried by the upper free end of the upwardly extending front end section of the connecting rod. It is, however, of advantage if the pivot pin is mounted on the transversely spaced webs projecting rearwardly from the abutment means. For this purpose it is for instance possible to mount on the rear face of the abutment means a plate on which bearing webs for the above-mentioned pivot pin as well as the bearing webs for pivotably mounting the front end of the guide linkage means are welded. According to a further feature of the present invention, the guide linkage means are provided rearwardly of the trough-shaped portion thereof with a housing portion forming a rearwardly open chamber in which the tilting unit is mounted. The tilting unit is thus properly protected. Nevertheless, this arrangement insures that coal particles, which may pass through some clearances into the aforementioned chamber, can escape in rearward direction therefrom. The housing portion may be formed at the rear end of the aforementioned chamber with a channel into which a rod connected to the housing portion may extend and the outwardly projecting end of the rod may be connected over an advancing unit constituted by fluid operated cylinder and piston means, to a mine roof support.

According to a further feature of the present invention, an annular guide is provided at the front end of the aforementioned chamber for guiding the rear end of the connecting rod. This annular guide may be held relatively short since the connecting rod has to be axially moved only through a short stroke for tilting the abutment. It is also advantageous that the cross-section of the rear portion of the connecting rod which is guided in the aforementioned annular guide is increased as compared with the remainder thereof. This makes it possible to provide the rear portion of the connecting rod with a bearing cutout in which a portion of the tilting unit is engaged. It is then advantageous that the piston rod head of the tilting unit is engaged in the aforementioned bearing cutout, whereas the cylinder of the tilting unit is connected to the guide linkage.

It is also advantageous that the total width of the trough-shaped section of the guide linkage is about 3 times the width of the connecting rod, which will assure a stable axial guidance of the connecting rod and proper torsion resistance of the arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
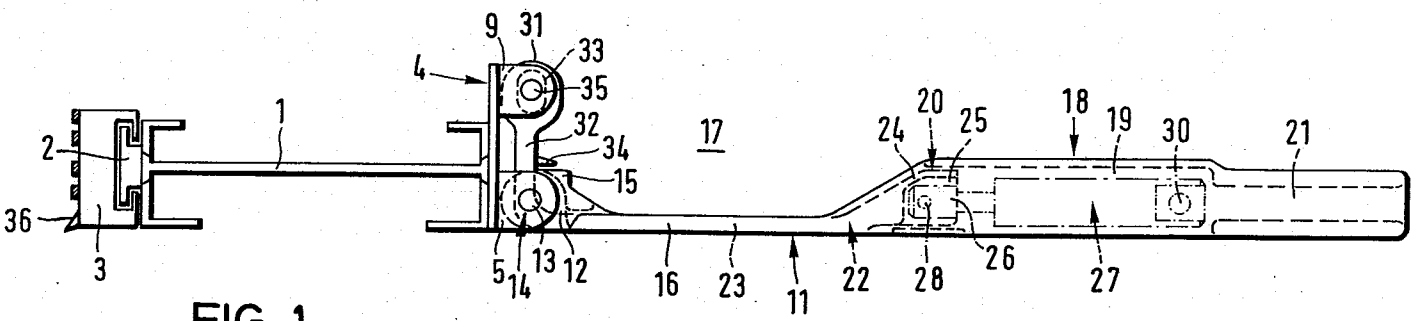
FIG. 1 is a schematic side view of the arrangement according to the present invention for controlled engagement of the tools of a coal planer mounted for reciprocation on abutment means in form of a scraper conveyor; the arrangement is shown in a rest position and the usually used mine roof support extending over the arrangement is omitted.
Figure 2:
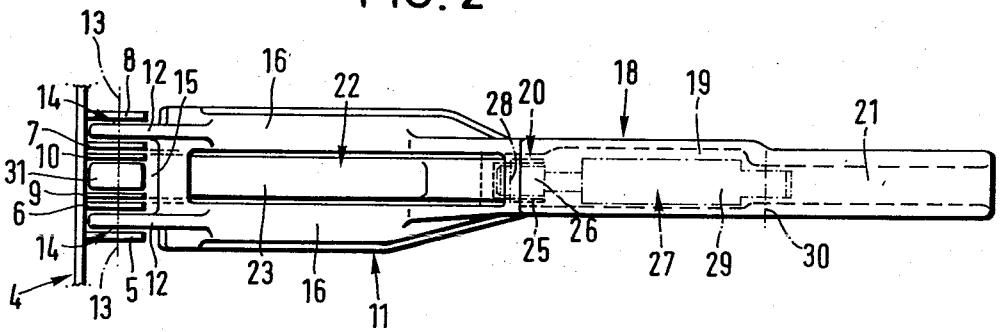
FIG. 2 is a top view of the arrangement shown in FIG. 1, in which for simplication reason the scraper chain conveyor and the coal planer mounted thereon for reciprocation are omitted.

The drawing shows a scrapper chain conveyor 1 provided at the front end thereof, which is directed toward a non-illustrated mine face, with a longitudinally extending guide rail 2 for a coal planer 3, so that the latter may be reciprocated along the guide rail by means not shown in the drawing. The scraper chain conveyor 1 is likewise only schematically shown, that is the drawing shows actually only the guide frame of the scraper chain conveyor, but not the upper and lower run of the latter. A plate-shaped connecting portion 4 is fixed in any convenient manner to the rear face of the scraper chain conveyor and four rearwardly extending pair-wise arranged webs 5–8 are welded in the region of the bottom portion of the plate 4 to the latter. Furthermore, an additional pair of webs 9 and 10 are likewise welded to the plate 4 in the region of the upper end thereof. A pair of transversely spaced ribs 12 respectively extend into the spaces formed between the webs 5, 6 and 7, 8 and the webs 5–8 as well as the afore-mentioned ribs are formed with aligned bores therethrough through which a pivot pin 13 extends to thus form a hinge 14 for the guide linkage means 11. In the region of the elevation of these hinges 14, a transverse web 15 is provided between the ribs 12.

The guide linkage means 11 comprises rearwardly of the hinges 14 two transversely spaced parallel bar-shaped sections 16, which rearwardly of the free space 17 thereabove are again connected to each other to form a housing shaped longitudinally extending section 18. A downwardly and rearwardly open chamber 19 is formed in the section 18. An annular guide 20 is provided at the front end of the chamber 19, whereas the rear end of the chamber 19 is extended by a channel 21 into which a non-illustrated connecting rod may be secured, which over a cylinder and piston unit, likewise not illustrated, and serving to move the whole arrangement toward the mine face, may be connected to a likewise not illustrated mine roof support extending over the arrangement.

The substantially bar-shaped shank 23 of the connecting rod which engages the sole of the mining gallery is guided with proper clearance between the bar-shaped sections 16 of the guide linkage 11 and the shank 23 has substantially the same thickness as the bar-shaped sections 16 of the guide linkage. At its rear end, shown in the drawing as the right end, the connecting rod 22 has a portion 24 of increased cross-section guided in the annular guide 20. The end section 24 of increased cross-section is provided with a bearing cutout 25 for the piston rod head 26 of the piston rod of the tilting unit, constructed as a fluid-operated cylinder and piston unit 27. The piston rod head 26 is coupled by means of a bolt 28 with the end section 24 of the connecting rod 22. The cylinder 29 of the tilting unit 27 engages with its free end into the channel 21 and is tiltably mounted in the latter by a transverse bolt 30.

On its end directed towards the mine face, the shank 23 of the connecting rod 22 passes under the transverse web 15 and is then continued by an upwardly directed shank 32 which in the region of its free end is provided with a lug 31 provided with an oblong aperture 33. About in the middle of its vertical extension a rearwardly projecting nose 34 is provided on the upright shank 32 and the nose 34 extends over the transverse web 15. The lug 31 is located between the webs 9 and 10 and is connected thereto by a bolt 35 which traverses the oblong aperture 33 in the lug 31.

Figure 3:
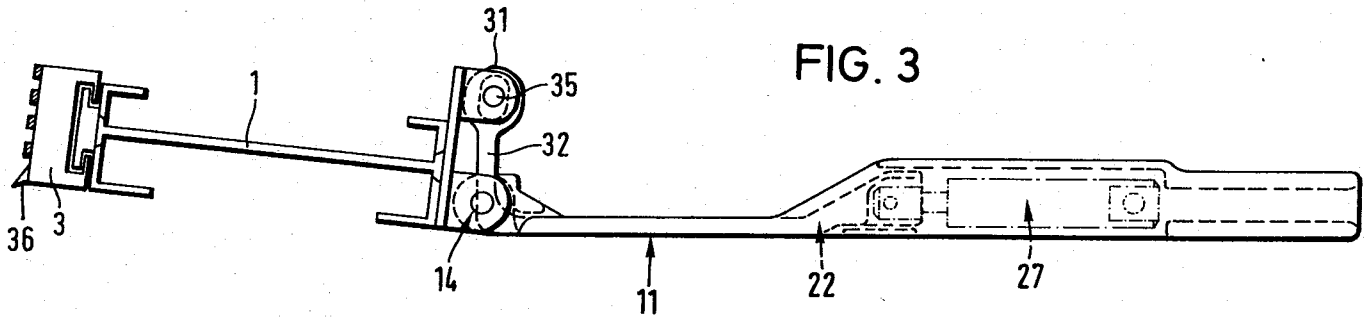
FIGS. 3 and 4 illustrate the arrangement according to FIGS. 1 and 2 in two different operating positions.

If, as shown in FIG. 3, the piston of the cylinder and piston unit 27 is impinged on one side with pressure fluid so that the piston rod connected thereto moves toward the right, as viewed in FIG. 3, that is away from the mine face, then the connecting rod 22 is likewise moved towards the right, whereby the lug 31 moves the bolt 35 passing therethrough in the direction towards the right, as viewed in FIG. 3. Thereby the scraper chain conveyor 1 is tilted about the hinge 14 between the guide linkage and the scraper chain conveyor in clockwise direction so that the front face of the scraper chain conveyor 1 and the coal planer guided thereon are lifted in upward direction.

Figure 4:
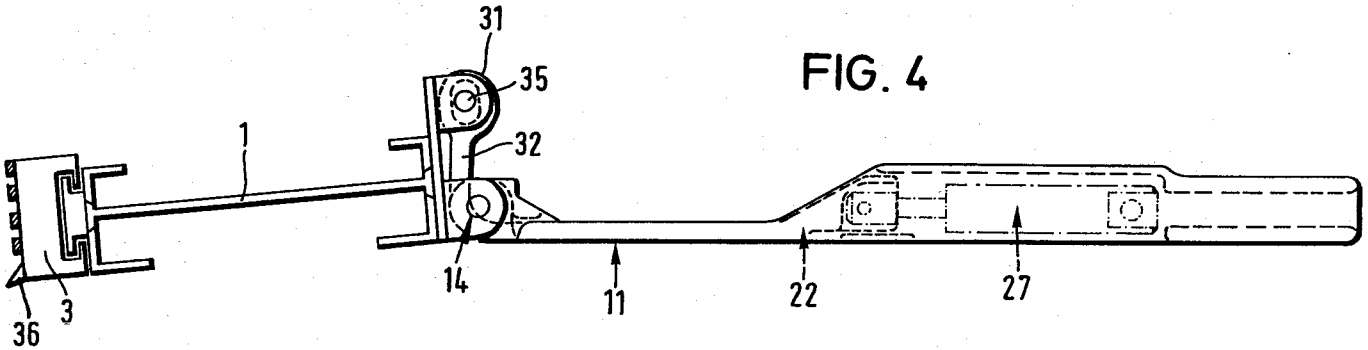

If, however, the other face of the piston of the cylinder and piston unit 27 is impinged by pressure fluid so that the piston and the piston rod connected thereto moves toward the left, as viewed in FIG. 4, that is toward the mine face, then the connecting rod 22 is moved in the same direction whereby the scraper chain conveyor and the coal planer mounted thereon are tilted in counter-clockwise direction about the hinge 14, which moves the tool 36 of the coal planer deeper into the sole of the mine gallery.

As can be seen from FIGS. 1–4 the shank 23 of the connecting rod remains in all operating positions located between the guide link means 11 without protruding upwardly or downwardly therefrom. Furthermore, the substantially vertical upwardly extending shank 32 of the connecting rod remains always closely adjacent to the rear face of the scraper chain conveyor 1. In this way a large free space is obtained above the trough-shaped length section 16 of the guide linkage means 11.

It will be understood that each of the elements described above, or two or more together, may also find a useful application in other types of arrangements for controlled engagement of the tools of a mining machine, especially a coal planer, with a mine face differing from the types described above.

While the invention has been illustrated and described as embodied in an arrangement for controlled engagement of the tools of a mining machine with a mine face comprising abutment means constituted by a scraper chain conveyor, guide rail means on the front face of the abutment means directed toward the mine face for guiding a mining machine for reciprocation along the mine face and means for tilting said abutment means and the mining machine guided thereon about a substantially horizontal tilting axis, it is not intended to be limited to the details shown, since various modifications and structural changes may be made without departing in any way from the spirit of the present invention.

Without further analysis, the foregoing will so fully reveal the gist of the present invention that others can, by applying current knowledged, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for controlled engagement of the tools of a mining machine, especially a coal planer, with a mine face, comprising abutment means having a front face directed towards the mine face and a rear face; guide rail means on said front face of said abutment means for guiding a mining machine for reciprocation in substantially horizontal direction along the mine face; and means for tilting said abutment means and said mining machine guided thereon about a substantially horizontal tilting axis, said tilting means being connected to and projecting rearwardly from said rear face of said abutment means and comprising elongated guide linkage means adapted to rest on the floor of the mine gallery and having a rear end section spaced from said rear face, connecting rod means guided in said guide linkage means for movement in longitudinal direction, one of said last-mentioned two means having an upwardly extending front end section pivotally attached in the region of the upper end thereof to said rear face of said abutment means, and the other of said last-mentioned two means having a front end pivotally attached to said rear face, and a tilting unit extending in the direction of said guide linkage means and being embedded and covered by said rear end section of the latter, said tilting unit being pivotally attached to the rear end of said connecting rod means.

2. An arrangement as defined in claim 1, wherein said abutment means is constituted by a scraper chain conveyor extending along the mine face.

3. An arrangement as defined in claim 1, wherein said upwardly extending front end section is provided on said connecting rod means.

4. An arrangement as defined in claim 3, wherein said upwardly extending front end section of said connecting rod means has in the region of its upper free end a lug provided with an oblong aperture and including a pivot pin carried by said abutment means in the region of said rear face thereof and extending through said aperture.

5. An arrangement as defined in claim 3, wherein said guide rail means and said connecting rod means in the region between the pivotal attachment of said guide means to said abutment means and the pivotal attachment of said connecting rod means to said tilting unit are of trough-shaped form and have wall portions adapted to engage the sole of the mine gallery of substantially the same thickness.

6. An arrangement as defined in claim 5, wherein said guide linkage means has in the region of its pivotally attached front end a raised transverse web and wherein said connecting rod means passes beneath said transverse web and is provided at its upwardly extending front end section with a rearwardly projecting nose which overlaps said transverse web.

7. An arrangement as defined in claim 6, wherein said guide linkage means is provided at the end thereof directed toward the mine face with a pair of transversely spaced ribs extending in longitudinal direction of said guide linkage means, said transverse web extending between said ribs.

8. An arrangement as defined in claim 5, wherein said guide linkage means has rearwardly of the trough-shaped portion thereof a housing portion forming a downwardly and rearwardly open chamber in which said tilting unit is located.

9. An arrangement as defined in claim 8, and including an annular guide provided at the front end of said chamber for guiding the rear end of said connecting rod.

10. An arrangement as defined in claim 9, wherein said guided rear end of said connecting rod means is provided with a bearing cutout in which a portion of said tilting unit is engaged.

11. An arrangement as defined in claim 10, wherein said tilting unit comprises a fluid operated cylinder-and-piston unit having a piston rod provided at its free end with a piston rod head located in said bearing cutout and pivotally connected to said rear end of said connecting rod means.

12. An arrangement as defined in claim 5, wherein the total width of said trough-shaped portion of said guide linkage means is about three times the width of said connecting rod means.

* * * * *